US008974020B2

(12) United States Patent
Chen

(10) Patent No.: US 8,974,020 B2
(45) Date of Patent: Mar. 10, 2015

(54) DEVICE FOR ADJUSTING GAP BETWEEN PLATEN AND PRINT HEAD AND INKJET PRINTER USING THE DEVICE

(75) Inventor: Yu-Ting Chen, New Taipei (TW)

(73) Assignees: Kinpo Electronics, Inc., New Taipei (TW); Cal-Comp Electronics & Communications Company Limited, New Taipei (TW)

( * ) Notice: Subject to any disclaimer, the term of this patent is extended or adjusted under 35 U.S.C. 154(b) by 60 days.

(21) Appl. No.: 13/615,599

(22) Filed: Sep. 14, 2012

(65) Prior Publication Data

US 2014/0028746 A1 Jan. 30, 2014

(30) Foreign Application Priority Data

Jul. 25, 2012 (TW) ..... 101126800 A

(51) Int. Cl.
*B41J 29/38* (2006.01)

(52) U.S. Cl.
USPC ..... 347/8; 400/56; 400/58

(58) Field of Classification Search
USPC ..... 347/5, 8, 9; 400/56, 58
See application file for complete search history.

(56) References Cited

U.S. PATENT DOCUMENTS 5,316,395 A * 5/1994 Imai ..... 400/56
8,384,944 B2 * 2/2013 Kawatoko et al. ..... 358/1.18
2007/0008361 A1 1/2007 Kawatoko et al.

FOREIGN PATENT DOCUMENTS

TW 467042 12/2001
TW 491188 6/2002

OTHER PUBLICATIONS

"Office Action of Taiwan Counterpart Application", issued on Oct. 17, 2014, pp. 1-7.

* cited by examiner

*Primary Examiner* — Lam S Nguyen
(74) *Attorney, Agent, or Firm* — Jianq Chyun IP Office

(57) ABSTRACT

A device for adjusting gap between platen and print head includes a base, a printing unit, a platen and a pair of adjusting elements. The printing unit is located on the base and includes a print head. The platen is located between the printing unit and the base, in which the platen has a platen-portion and a pair of adjusting-portions, the adjusting-portions are disposed at opposite sides of the platen-portion, and each of the adjusting-portions has a step-guiding-surface. The adjusting elements are disposed beside the platen and correspondingly contact the step-guiding-surfaces of the adjusting-portions, in which the distance between the platen and the print head is varied with positions of the adjusting elements relative to the step-guiding-surfaces.

35 Claims, 7 Drawing Sheets

DEVICE FOR ADJUSTING GAP BETWEEN PLATEN AND PRINT HEAD AND INKJET PRINTER USING THE DEVICE

CROSS-REFERENCE TO RELATED APPLICATION

This application claims the priority benefit of Taiwan application serial no. 101126800, filed on Jul. 25, 2012. The entirety of the above-mentioned patent application is hereby incorporated by reference herein and made a part of this specification.

BACKGROUND OF THE INVENTION

1. Field of the Invention

The invention generally relates to a device for adjusting gap between platen and print head, and more particularly, to a device for adjusting gap between platen and print head which is able to adjust the distance between a print head and a platen.

2. Description of Related Art

Currently, before shipping out inkjet printers, it is required to appropriately adjust and calibrate them by staff, so that the distance between the print head (cartridge) of each inkjet printer and the platen helping the paper to be printed passing through can be kept within a specific range. However after shipping the printer, the thicknesses of the paper to be printed are different in the application practice, so that the distance between the print head and the platen is varied somehow. The above-mentioned distance is important to affect the printing resolution. In short, for a same printer, due to the different thickness of the paper to be printed, the printing quality on the printed paper would be affected.

In addition, the tolerance in the manufacture and the assembling of the components and sub-assemblies of the aforementioned inkjet printer may cause the distance between the print head and the paper to be printed varied, which also affects the printing quality so that a solution to overcome the above-mentioned problem is demanded.

SUMMARY OF THE INVENTION

Accordingly, the invention is directed to a device for adjusting gap between platen and print head configured to adjust the distance between the print head and the platen.

The invention is also directed to an inkjet printer using the above-mentioned device for adjusting gap between print head and platen.

The invention provides a device for adjusting gap between platen and print head, which includes a base, a printing unit, a platen and a pair of adjusting elements. The printing unit is located on the base and includes a print head. The platen is located between the printing unit and the base, in which the platen has a platen-portion and a pair of adjusting-portions, the adjusting-portions are disposed at opposite sides of the platen-portion, and each of the adjusting-portions has a step-guiding-surface. The adjusting elements are disposed beside the platen and correspondingly contact the step-guiding-surfaces of the adjusting-portions, in which the distance between the platen and the print head is varied with positions of the adjusting elements relative to the step-guiding-surfaces.

The invention also provides an inkjet printer, which includes a host and the above-mentioned device for adjusting gap between platen and print head, in which the host has a casing and the device for adjusting gap between platen and print head is disposed in the casing. The casing has the above-mentioned base and at least one of adjusting elements are exposed out of the casing.

Based on the description above, in the device for adjusting gap between platen and print head and the inkjet printer using the device of the invention, the adjusting elements are used to adjust the distance between the platen and the print head. Therefore, regardless thickness of the paper to be printed used by a terminal user, the distance between the paper sheet and the print head can be appropriately adjusted by the user to reach a good printing effect.

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE EMBODIMENTS

In general speaking, the printing resolution of every inkjet printer before shipping out from the manufactures has been roughly set, and the conventional inkjet printer today usually has a program for controlling the ink-throughput of the print head against different paper sheets so as to calibrate the printing quality. In comparison with the conventional inkjet printer, the scheme of the invention rests in that the distance between the platen and the print head is adjustable by a mechanism to optimize the printing quality.

In order to make the aforementioned and other features and advantages of the invention comprehensible, several exemplary embodiments accompanied with figures are described in detail below.

In addition, in the following, the depicted embodiments together with the included drawings are intended to explain the feasibility of the invention, wherein a same notation or a similar notation is for marking the same or the similar portions. Note that some of expression words hereinafter regarding direction or orientation, such as 'up', 'down', 'left', 'right', 'above', 'below', 'towards left', 'towards right' and the like, are to describe the relative positions, not to limit, the invention.

The First Embodiment

Figure 1:
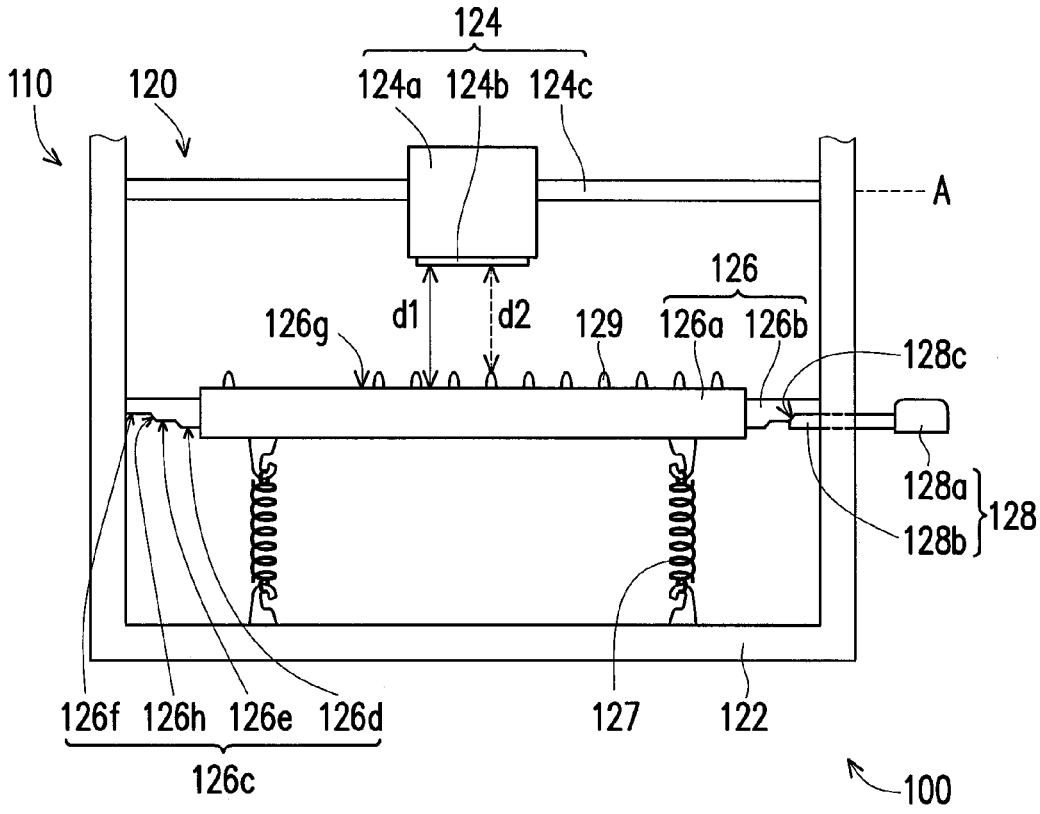
FIG. 1 is a schematic diagram of an inkjet printer according to the first embodiment of the invention.
Figure 2:
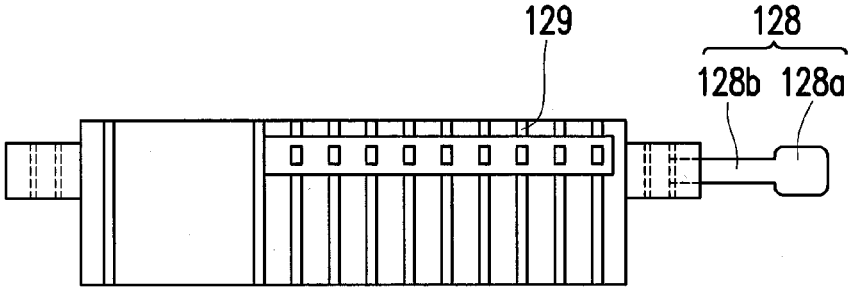
FIG. 2 is a top-view diagram of the device for adjusting gap between platen and print head in the inkjet printer of FIG. 1.

FIG. 1 is a schematic diagram of an inkjet printer according to the first embodiment of the invention and FIG. 2 is a top-view diagram of the device for adjusting gap between platen and print head in the inkjet printer of FIG. 1.

Referring to FIGS. 1 and 2, an inkjet printer 100 of the embodiment includes a host 110 and a device 120 for adjusting gap between platen and print head, in which the device 120 for adjusting gap between platen and print head is installed in the casing (not marked) of the host 110 and the casing has the casing has a bottom-portion and a plurality of sidewalls vertically connecting the bottom-portion.

The device 120 for adjusting gap between platen and print head includes a base 122, a printing unit 124, a platen 126, a pair of elastic elements 127 and a pair of adjusting elements 128. The base 122 is the bottom-portion of the above-mentioned casing, and the printing unit 124 is located on the base 122 and includes a print head 124*a*. The platen 126 is located between the inkjet unit 124 and the base 122 and has a platen-portion 126*a* and a pair of adjusting-portions 126*b*. The adjusting-portions 126*b* are disposed at opposite sides of the platen-portion 126*a* and each of the adjusting-portions 126*b* has a step-guiding-surface 126*c*. The elastic elements 127 are connected between the platen 126 and the base 122, while the adjusting elements 128 are disposed beside the platen 126 and correspondingly contact the step-guiding-surfaces 126*c* of the adjusting-portions 126*b*, in which the distance between the platen 126 and the print head 124*a* is varied with the positions of the adjusting elements 128 relative to the step-guiding-surfaces 126*c*.

The above-mentioned distance d1 between the platen 126 and the print head 124*a* means the distance d1 between the surface 126*g* of the platen 126 facing the print head 124*a* and the nozzle 124*b* of the print head 124*a*, not the distance d2 between the tops (not marked) facing the print head 124*a* of the carry elements 129 disposed on the platen 126 and protruded from the surface 126*g* of the platen 126 and the nozzle 124*b* of the print head 124*a*.

The printing unit 124 includes a shaft rod 124*c* and the above-mentioned print head 124*a*, in which the shaft rod 124*c* is located on the platen 126, and the print head 124*a* is pivoted on the shaft rod 124*c* and adapted to move along the axis direction A of the shaft rod 124*c*. In addition, the elastic elements 127 of the embodiment are tension springs, the step-guiding-surfaces 126*c* face the base 122 and the steps-segment directions of the step-guiding-surfaces 126*c* located at both opposite sides of the platen 126 are opposite to each other.

It should be noted that the above-mentioned steps-segment means a plurality of treading surfaces 126*d*, 126*e* and 126*f* and guiding kick-off surfaces 126*h* of the step-guiding-surface 126*c*, in which the treading surfaces 126*d*, 126*e* and 126*f* are parallel to the axis direction A of the shaft rod 124*c* and the guiding kick-off surfaces 126*h* have an angle towards the axis direction A and are connected between the treading surfaces 126*d* and 126*e* or between the treading surfaces 126*e* and 126*f*. In the embodiment, the step-guiding-surface 126*c* has two guiding kick-off surfaces 126*h* and three treading surfaces 126*d*, 126*e* and 126*f*, thus it is a 3-steps steps-segment. The steps-segment directions of the step-guiding-surfaces 126*c* located at both opposite sides of the platen 126 are opposite to each other, which means the closer to the platen 126 (i.e., the steps-segment faces down), the closer to the base 122 the treading surfaces of the step-guiding-surfaces 126*c* are.

At least one of the adjusting elements 128 has a push-button 128*a*, each of the adjusting elements 128 has a leaning-portion 128*b*, the push-button 128*a* is connected to the corresponding leaning-portion 128*b*, the above-mentioned adjusting-portion 126*b* correspondingly leans against one of the treading surfaces 126*d*, 126*e* and 126*f* of the step-guiding-surface 126*c* of the adjusting-portion 126*b*, and the treading surfaces 126*d*, 126*e* and 126*f* of the two adjusting-portions 126*b* leant by the two leaning-portions 128*b* respectively belong to the same step. In other words, the two leaning-portions 128*b* would simultaneously lean against the two treading surfaces 126*d*. For operation convenience, the push-button 128*a* is exposed out of the host 110.

It should be noted that in order to allow the leaning-portion 128*b* smoothly moving relative to the step-guiding-surface 126*c*, the guiding kick-off surface 126*h* of the step-guiding-surface 126*c* has an angle towards the axis direction A and is connected between the two treading surfaces 126*d* and 126*e* or between the treading surfaces 126*e* and 126*f*, so that while the leaning-portion 128*b* is approaching towards the direction relatively close to the platen-portion 126*a*, the guiding inclined surfaces 128*c* of the leaning-portions 128*b* and the guiding kick-off surfaces 126*h* of the step-guiding-surface 126*c* would be guided by each other to help the leaning-portions 128*b* smoothly arriving at the next-step treading surface.

Figure 3:
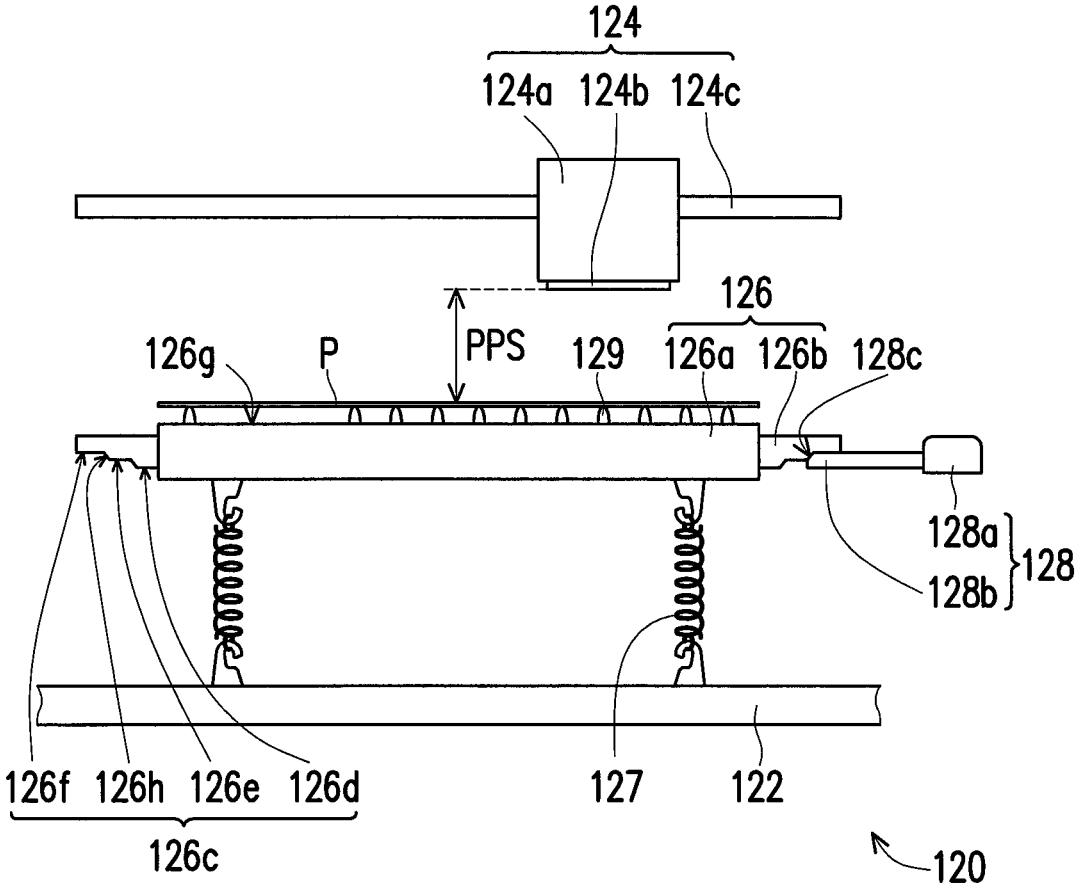
FIGS. 3-5 are diagrams showing paper sheets are placed on the platen and the leaning-portion of the adjusting element leans against different step treading surfaces of a step-guiding-surface.
Figure 4:
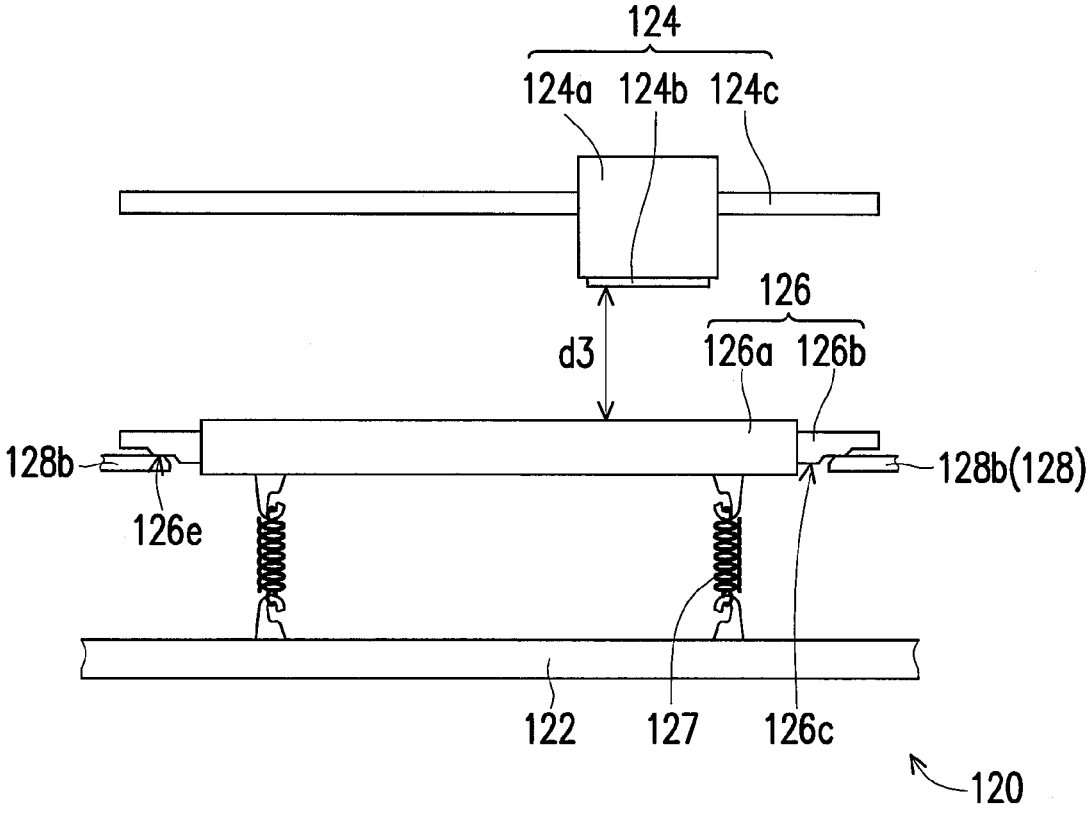
Figure 5:
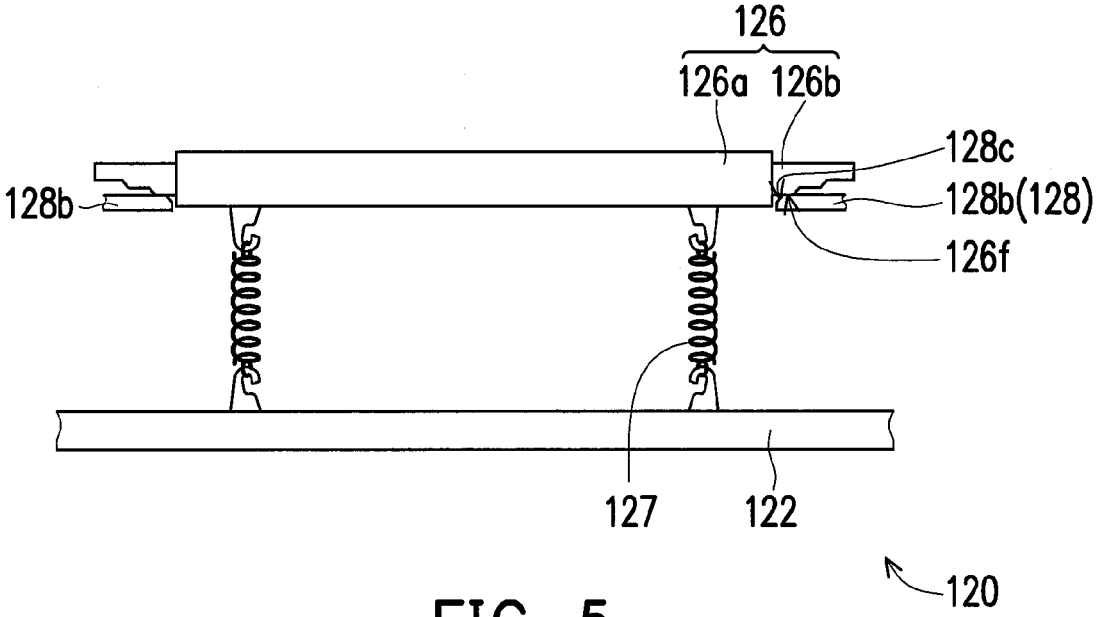

FIGS. 3-5 are diagrams showing paper sheets are placed on the platen and the leaning-portion of the adjusting element leans against different step treading surfaces of a step-guiding-surface. For simplicity and description convenience, the casing of the host 110 in FIGS. 3-5 is omitted; instead, only the base 122 is directly illustrated. Referring to FIG. 3, in the embodiment, the leaning-portions 128*b* of the two adjusting elements 128 lean against two first-step treading surfaces 126*f* of the two step-guiding-surfaces 126*c* outmost relative to the platen 126. In comparison with the other layout where the leaning-portions 128*b* of the adjusting elements 128 lean against the other treading surfaces 126*d* and 126*e* of the step-guiding-surface 126*c*, in the embodiment, the leaning-portions 128*b* of the two adjusting elements 128 lean against the treading surfaces 126*f* of the two step-guiding-surface 126*c* outmost relative to the platen-portion 126*a* of the platen 126 so that the distance between the surface 126*g* of the platen 126 and the print head 124*a* is the maximal.

During printing of the inkjet printer 100, the paper sheet P enters onto the platen 126 of the device 120 for adjusting gap between the platen 126 and print head 124*a* through a paper-feeding procedure and stays at the printing position. At the time, there is a paper-printhead space (PPS) between the print head 124*a* of the printing unit 124 and the paper sheet P. Since the paper sheet P is carried by the carry element 129 disposed on the platen 126, the PPS between the paper sheet P and the print head 124*a* is less than the distance d1 between the platen 126 and the print head 124*a*.

Once the thickness of the paper sheet P conforms to the suggested thickness of the paper sheet P by the inkjet printer 100, there is no need to adjust the distance d1 between the platen 126 and the print head 124*a* for obtaining the optimum printing quality.

However, if the thickness of the paper sheet P to be printed is less than the suggested thickness of the paper sheet P by the inkjet printer 100, the terminal user can push the push-button 128*a* with the finger to make the leaning-portions 128*b* move towards the platen-portion 126*a* so as to lean against the second-step treading surfaces 126*e* of the step-guiding-surfaces 126*c*. At the time, the platen 126 is lifted relative to the base 122 and the elastic elements 127 produce a pre-stored elastic resuming force, as shown by FIG. 4.

In FIG. 4, the distance d3 between the platen 126 and the print head 124*a* is less than the distance d1 between the platen 126 and the print head 124*a* in FIG. 3. Thus, without adjusting the printing resolution by a program, although the thickness of the paper sheet P to be printed is less than the suggested thickness of the paper sheet P by the inkjet printer 100, but the distance between the paper sheet P and the print head 124*a* gets smaller as well, so that the printing quality still is good. At the time, if the program is used to adjust the printing resolution (i.e., the ink throughput of the print head 124*a*), the printing quality would be better.

The user can further push the two adjusting elements 128 so that the leaning-portions 128*b* of the two adjusting elements 128 lean against the third-step treading surfaces 126*f* of the step-guiding-surfaces 126*c*, so that the distance between the paper sheet P (shown by FIG. 3) and the print head 124*a* gets the smallest.

It is clear, when the height of the carry element 129 relative to the surface 126*g* of the platen 126 and the height of the printing unit 124 keep unchanged, people skilled in the art should be aware of that when the distance d1 between the platen 126 and the nozzle 124*b* of the print head 124*a* is adjusted and varied, the PPS between the paper sheet P carried on the platen 126 and the print head 124*a* would be accordingly varied, which can effectively control the printing quality.

Although in the embodiment, the above-mentioned description is against the example that the terminal user uses the finger to manually move the push-buttons 128*a* of the adjusting elements 128 to change the distance between the platen 126 and the print head 124*a*, but any one skilled in the art can also change the push-button 128*a* into a press-button according to the demand so that the terminal user can manually press the press-button to start the program to control and adjust the distance between the platen 126 and the print head 124*a*. The designer can also use a sensor (not shown) disposed in the casing of the host 110, so that the sensor can automatically detect the thickness of the paper to decide whether or not adjusting the distance between the platen 126 and the print head 124*a*. The time for adjusting the distance between the platen 126 and the print head 124*a* is determined by the design or the real application. For example, the paper thicknesses of various brands are normally marked on the package, so that the user can adjust the distance between the platen 126 and the print head 124*a* prior to printing according to the known information; or it is decided during printing to adjust the distance between the platen 126 and the print head 124*a* according to the thickness detection result of the sensor.

Figure 6:
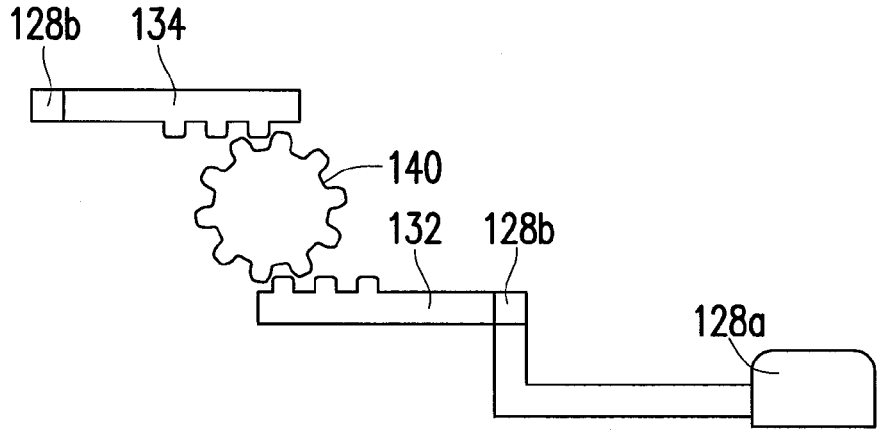
FIG. 6 is a schematic diagram shown a layout to enable a plurality of leaning-portions simultaneously acting.

FIG. 6 is a schematic diagram shown a layout to enable a plurality of leaning-portions of the adjusting elements simultaneously acting. Referring to FIG. 6, the adjusting elements 128 in the embodiment move the leaning-portions 128*b* by the user to push the push-button 128*a*, in which since only one of the adjusting elements 128 has the push-button 128*a*, when the user pushes the push-button 128*a*, the two leaning-portions 128*b* must simultaneously act to approach to the platen-portion 126*a* (shown by FIG. 1). To make the two leaning-portions 128*b* simultaneously act in the embodiment, two racks 132 and 134 and a gear 140 are used, in which the push-button 128*a* is connected to the rack 132 and each of the racks 132 and 134 has a leaning-portion 128*b* and the racks 132 and 134 are engaged with the gear 140. In the above-mentioned layout, when the user pushes the push-button 128*a*, the leaning-portion 128*b* disposed on the same rack 132 as the push-button 128*a* would approach to the gear 140 and, together with the rack 132 connected to the push-button 128*a*, simultaneously drives the gear 140 for rotation, which further brings the leaning-portion 128*b* of another rack 134 engaged with the gear 140 to approach to the gear 140. In short, at the time, the two leaning-portions 128*b* are closed to each other. It is certainly to make the two adjusting elements 128 individually have a push-button 128*a* and the two adjusting elements 128 are subsequently pushed during adjusting the distance between the platen 126 and the print head 124*a*, in which the adjusting elements 128 can be pushed manually by the user or by program control.

It can be seen the two adjusting elements 128 can move subsequently or simultaneously, and both can achieve the same goal.

To make the distance between the platen 126 and the print head 124*a* of the inkjet printer 100 larger than the distance of the previous state, the push-button 128*a* is pushed reversely to further move the leaning-portions 128*b*. At the time, the pre-stored elastic resuming forces of the elastic elements 127 make the platen 126 close to the base 122, which can adjust the distance between the platen 126 and the print head 124*a* to be larger than before.

Although the gap in the embodiment gets adjusted by a three-steps segment design composed of two guiding kick-off surfaces and three treading surfaces as an example, but people skilled in the art can also use multi segments design to adjust the gap in response to different thicknesses of the paper sheet P. For example, the more the number of the treading surfaces, the more the number of the adjustable segments of the gap is.

The Second Embodiment

The embodiment is basically the same as the first embodiment, and a same notation or a similar notation is for marking the same or the similar portions, in which the same content is omitted for simplicity.

Figure 7:
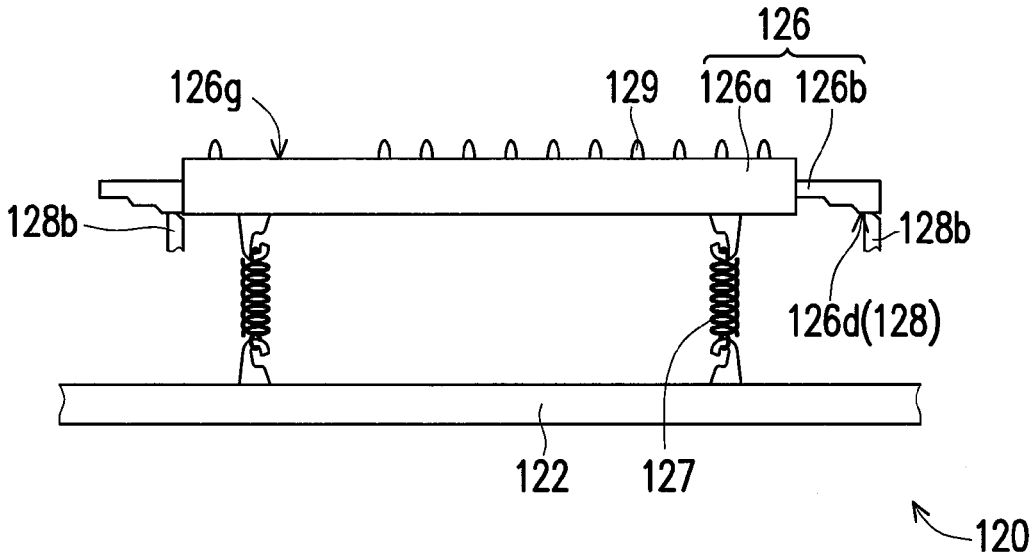
FIGS. 7 and 8 are schematic diagrams of a device for adjusting gap between platen and print head according to the second embodiment of the invention.
Figure 8:
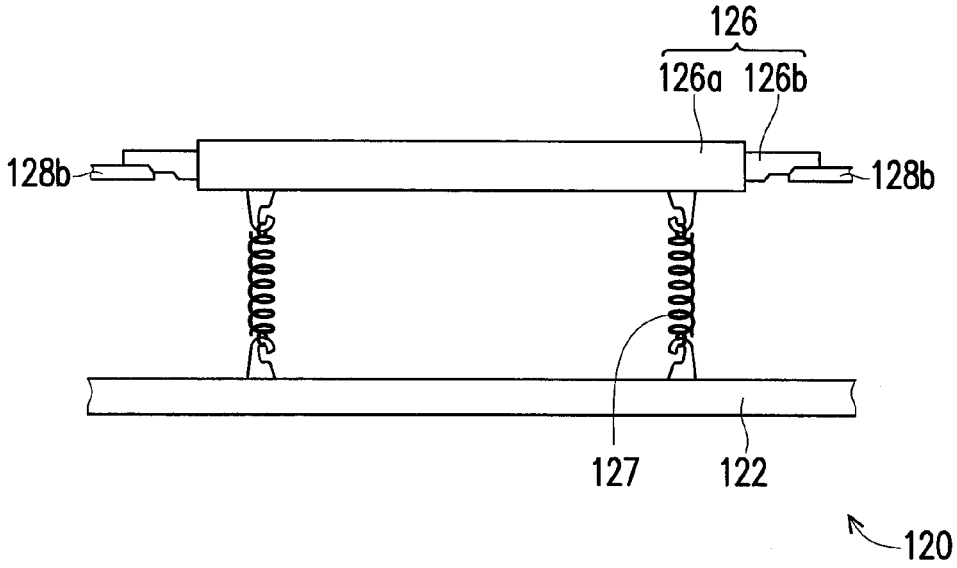

FIGS. 7 and 8 are schematic diagrams of a device 120 for adjusting gap between a platen 126 and a print head 124*a* according to the second embodiment of the invention, in which the leaning-portions 128*b* in FIGS. 7 and 8 are respectively located on different treading surfaces. Referring to FIGS. 7 and 8, in the embodiment, the steps-segment directions of the two step-guiding-surfaces 126*c* at opposite sides of the platen-portion 126*a* of the platen 126 are the same.

The same steps-segment directions of the two step-guiding-surfaces 126*c* at opposite sides of the platen-portion 126*a* of the platen 126 herein mean the treading surfaces of the two step-guiding-surfaces 126*c* at the two sides of the platen-portion 126*a* are more closed to the base 122 towards the right direction of the shaft rod 124*c*, while the treading surfaces are more far away from the base 122 towards the left direction of the shaft rod 124*c*.

It can be seen from FIGS. 7 and 8 that when the leaning-portions 128*b* are located on the third-step treading surfaces 126*d* (shown by FIG. 7), the distance between the platen 126 and the base 122 is larger so that the distance between the platen 126 and the print head 124*a* is smaller. When the leaning-portions 128*b* are located on the first-step treading surfaces 126*c* (shown by FIG. 8), the distance between the platen 126 and the base 122 is smaller so that the distance between the platen 126 and the print head 124*a* is larger. It can be seen from FIGS. 7 and 8 that when the leaning-portions

128*b* lean against different treading surfaces, the height of the platen 126 relative to the base 122 is different and, by using the feature, the distance between the platen 126 and the print head 124*a* can be adjusted.

The Third Embodiment

Figure 9:
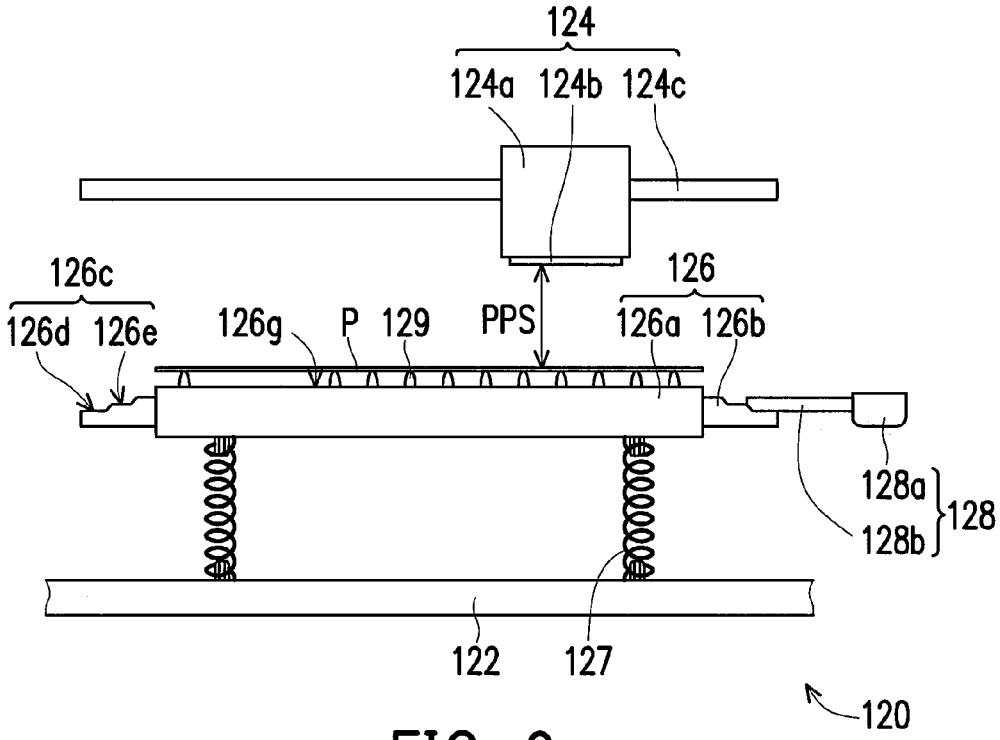
FIG. 9 is a schematic diagram of a device for adjusting gap between platen and print head according to the third embodiment of the invention.

The embodiment is basically the same as the first and second embodiments, and a same notation or a similar notation is for marking the same or the similar portions, in which the same content is omitted for simplicity FIG. 9 is a schematic diagram of a device 120 for adjusting gap between platen 126 and print head 124*a* according to the third embodiment of the invention. Referring to FIG. 9, in the embodiment, the elastic elements 127 are compression springs, the step-guiding-surfaces 126*c* face the printing unit 124 and the steps-segment directions of the two step-guiding-surfaces 126*c* at opposite sides of the platen-portion 126*a* of the platen 126 are opposite to each other, which means the more close to the platen-portion 126*a* of the platen 126, the more far away from the base 122 the treading surfaces of the step treading surfaces 126*c* are.

Continuing to FIG. 9, the leaning-portions 128*b* lean against the step-guiding-surfaces 126*c* from the position above the step-guiding-surfaces 126*c* and, along the leaning-portions 128*b* approach to and lean against onto the second-step treading surfaces 126*e* from the first-step treading surfaces 126*d* of the step-guiding-surfaces 126*c*, the platen 126 would be relatively closed to the base 122 (i.e., the platen 126 is more far away from the print head 124*a*), and at the time, the compression springs produce pre-stored elastic resuming forces. The more far away from the base 122 the treading surfaces are which the leaning-portion 128*b* lean against, the larger the pre-stored elastic resuming forces of the compression springs are.

It can be seen from the description above that the distance between the platen 126 and the print head 124*a* can be selected by multiple segments depending on the different steps of the treading surfaces which the leaning-portion 128*b* lean against, and the gaps can be adjusted according to the thickness of the paper sheet P.

The Fourth Embodiment

The embodiment is basically the same as the third embodiment, and a same notation or a similar notation is for marking the same or the similar portions, in which the same content is omitted for simplicity.

Figure 10:
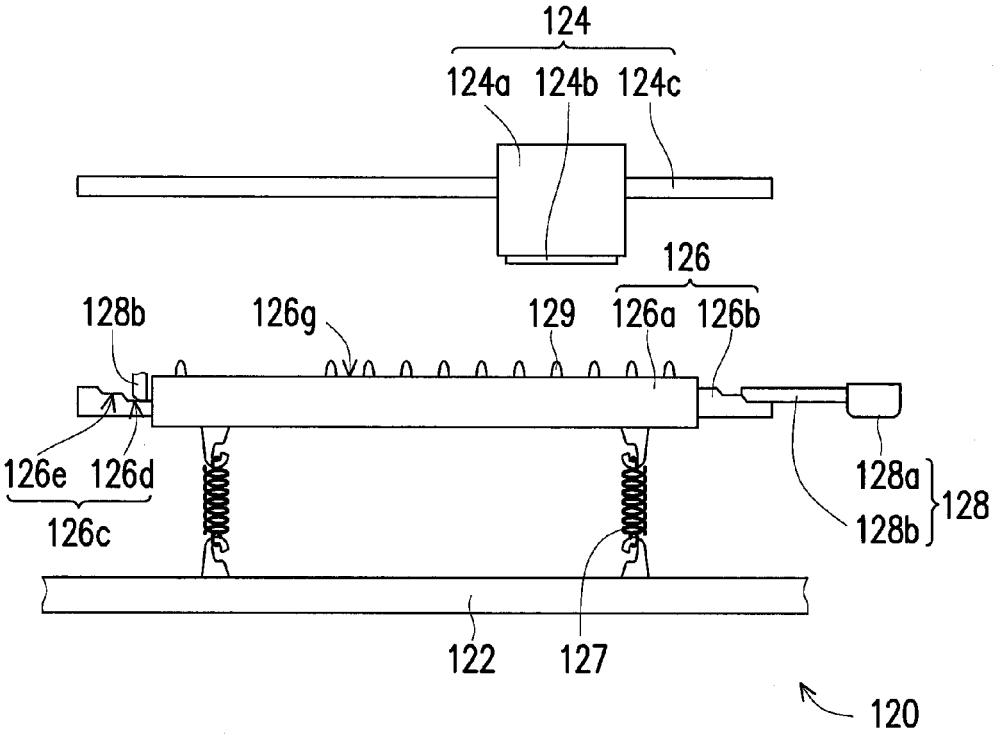
FIG. 10 is a schematic diagram of a device for adjusting gap between platen and print head according to the fourth embodiment of the invention.

FIG. 10 is a schematic diagram of a device for adjusting gap between platen and print head according to the fourth embodiment of the invention. Referring to FIG. 10, in the embodiment, the steps-segment directions of the two step-guiding-surfaces 126*c* at opposite sides of the platen 126 are the same. The same steps-segment directions of the two step-guiding-surfaces 126*c* at opposite sides of the platen 126 herein mean the treading surfaces of the two step-guiding-surfaces 126*c* at the two sides of the platen-portion 126*a* are more close to the base 122 towards the right direction of the shaft rod 124*c*, while the treading surfaces are more far away from the base 122 towards the left direction of the shaft rod 124*c*

The Fifth Embodiment

The embodiment is basically the same as the above-mentioned four embodiments, and a same notation or a similar notation is for marking the same or the similar portions, in which the same content is omitted for simplicity.

Figure 11:
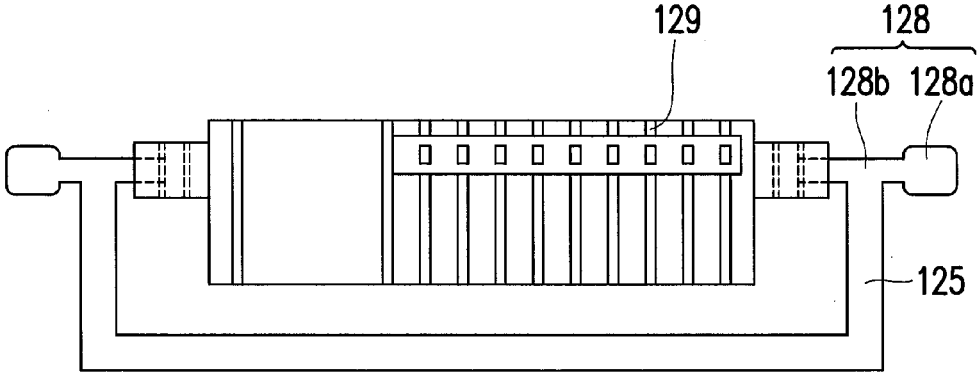
FIG. 11 is a schematic diagram of a device for adjusting gap between platen and print head according to the fifth embodiment of the invention.

FIG. 11 is a schematic diagram of a device for adjusting gap between platen and print head according to the fifth embodiment of the invention. Referring to FIG. 11, in the embodiment, there is further a body 125 between the two adjusting elements 128 and the body 125 is connected between the two leaning-portions 128*b*. The body 125 can be connected between the two leaning-portions 128*b* in different ways of crossing the sides and the upper side of the platen 126 or crossing the sides and the lower side of the platen 126 according to the real demand of the elements of the inkjet printer 100. In the embodiment, the push-button 128*a*, the leaning-portions 128*b* and the body 125 can be integrally formed or assembled together, which the invention is not limited to.

In more details, the body 125 is used to connect the two adjusting elements 128 together to form a structure similar to a frame. In this way, only one push-button 128*a* enable to make the two adjusting elements 128 simultaneously act when the user pushes the push-button 128*a*. In addition, the leaning-portions 128*b* lean against the step-guiding-surfaces 126*c* from the position below the adjusting-portion 126*b* so that the platen 126 is supported by the frame structure so as to save the elastic elements 127.

The Sixth Embodiment

The embodiment is basically the same as the above-mentioned five embodiments, and a same notation or a similar notation is for marking the same or the similar portions, in which the same content is omitted for simplicity.

Figure 12:
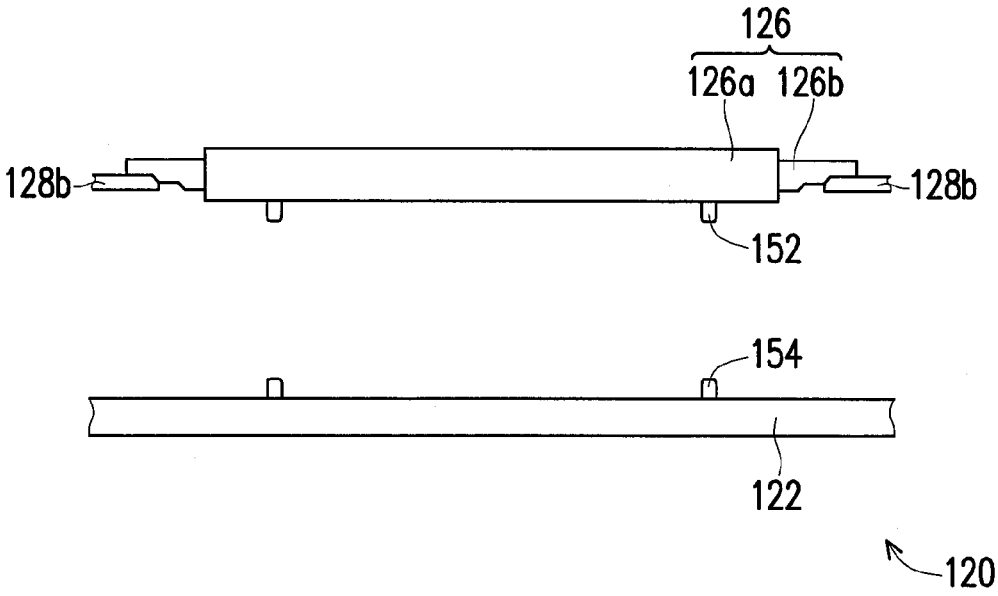
FIG. 12 is a schematic diagram of a device for adjusting gap between platen and print head according to the sixth embodiment of the invention.

FIG. 12 is a schematic diagram of a device for adjusting gap between platen and print head according to the sixth embodiment of the invention. Referring to FIG. 12, in the embodiment, no elastic element is used to help adjusting the distance between the platen 126 and the print head 124*a* (shown by FIG. 10). Instead, a magnet 152 is used and disposed on the surface (not shown) of the platen 126 facing the base 122. Meanwhile, another magnet 154 is disposed on the surface (not shown) of the base 122 facing the platen 126, in which the magnets 152 and 154 with corresponding positions are attractive by each other.

The Seventh Embodiment

The embodiment is basically the same as the sixth embodiment, and a same notation or a similar notation is for marking the same or the similar portions, in which the same content is omitted for simplicity.

Figure 13:
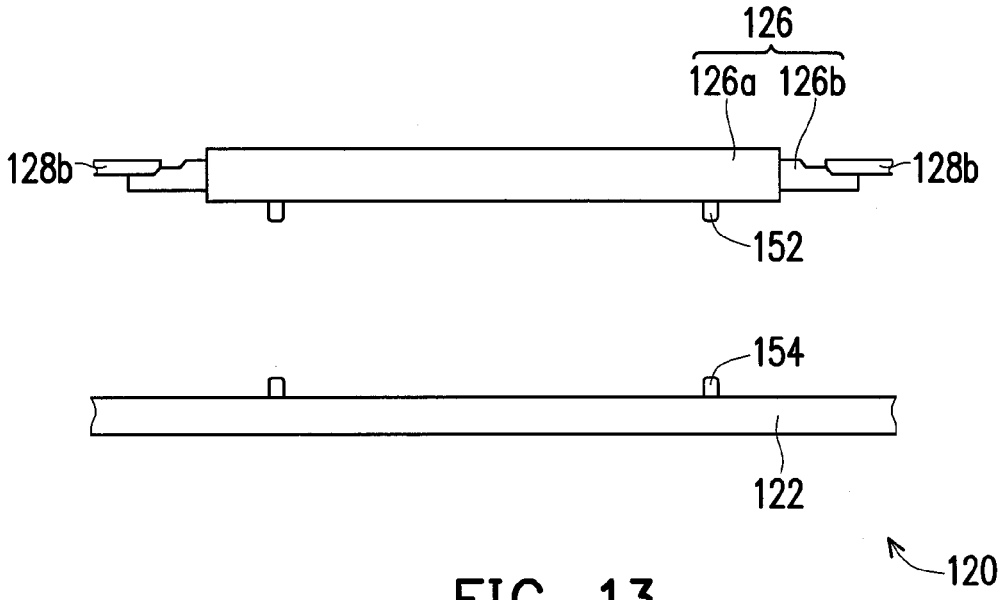
FIG. 13 is a schematic diagram of a device for adjusting gap between platen and print head according to the seventh embodiment of the invention.

FIG. 13 is a schematic diagram of a device for adjusting gap between platen and print head according to the seventh embodiment of the invention. Referring to FIG. 13, in the embodiment, no elastic element is used to help adjusting the distance between the platen 126 and the print head 124*a* (shown by FIG. 10). Instead, a magnet 152 is used and disposed on the surface (not labelled) of the platen 126 facing the base 122. Meanwhile, another magnet 154 is disposed on the surface (not labelled) of the base 122 facing the platen 126, in which the magnets 152 and 154 with corresponding positions are attractive to each other.

In summary, in the device for adjusting gap between platen and print head and the inkjet printer using the device for adjusting gap between platen and print head of the invention, the adjusting elements in association with adjusting-portions of the platen are used to adjust the distance between the platen and the print head by the terminal user in response to the different thicknesses of the paper. Therefore, regardless thickness of the paper, a good printing quality is achieved. In short, the terminal user can independently adjust the inkjet printer to the optimum printing mode against different thicknesses of paper.

In addition, the unavoidable fabrication and assembling tolerances of the parts make the real distance between the nozzle of the print head and the platen varied, which further affects the distance between the nozzle and the paper sheet to be printed. However, by using the device for adjusting gap between platen and print head of the invention, the calibration stuff can adjust the distance between the nozzle of the print head and the platen to the predetermined value before shipping out from the manufactures. In comparison with the prior art where the distance between the nozzle of the print head and the platen in the printer is fixed so that the negative affecting of the varied distance between the nozzle of the print head and the platen caused by the tolerances of the components and sub-assemblies are unable reduced by the adjustment. In addition, the device for adjusting gap between platen and print head and the inkjet printer using the device for adjusting gap between platen and print head of the invention further have calibration convenience before the shipping out.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter.

What is claimed is:

1. A device for adjusting gap between platen and print head, comprising:

a base;

a printing unit, located on the base and comprising a print head;

a platen, located between the printing unit and the base, wherein the platen has a platen-portion and a pair of adjusting-portions, the pair of adjusting-portions are disposed at opposite sides of the platen-portion, and each of the adjusting-portions has a step-guiding-surface; and a pair of adjusting elements, disposed beside the platen and correspondingly contacting the step-guiding-surfaces of the pair of adjusting-portions, wherein distance between the platen and the print head is varied with positions of the adjusting elements relative to the step-guiding-surfaces, wherein each of the adjusting elements has a leaning-portion that correspondingly leans against the step-guiding-surface of one of the adjusting-portions, where one of the adjusting elements further has a push-button that is connected to the leaning-portion and located at an end of the leaning-portion far away from the platen-portion.

2. The device for adjusting gap between platen and print head as claimed in claim 1, wherein the printing unit comprises:

a shaft rod, located on the platen; and the print head, pivoted on the shaft rod and adapted to move along the axis direction of the shaft rod.

3. The device for adjusting gap between platen and print head as claimed in claim 1, further comprising: at least one elastic element connected between the platen and the base.

4. The device for adjusting gap between platen and print head as claimed in claim 3, wherein the elastic elements are tension springs.

5. The device for adjusting gap between platen and print head as claimed in claim 4, wherein the step-guiding-surfaces face the base.

6. The device for adjusting gap between platen and print head as claimed in claim 5, wherein steps-segment directions of the step-guiding-surfaces located at opposite sides of the platen are opposite to each other.

7. The device for adjusting gap between platen and print head as claimed in claim 5, wherein steps-segment directions of the step-guiding-surfaces located at opposite sides of the platen are the same.

8. The device for adjusting gap between platen and print head as claimed in claim 3, wherein the elastic elements are compression springs.

9. The device for adjusting gap between platen and print head as claimed in claim 8, wherein the step-guiding-surfaces face the printing unit.

10. The device for adjusting gap between platen and print head as claimed in claim 9, wherein steps-segment directions of the step-guiding-surfaces located at opposite sides of the platen are opposite to each other.

11. The device for adjusting gap between platen and print head as claimed in claim 9, wherein steps-segment directions of the step-guiding-surfaces located at opposite sides of the platen are the same.

12. The device for adjusting gap between platen and print head as claimed in claim 1, wherein there is further a body between the pair of adjusting elements, and the body is connected between the pair of leaning-portion and located beside the platen.

13. The device for adjusting gap between platen and print head as claimed in claim 1, wherein the push-button, the leaning-portions and the body are integrally formed.

14. The device for adjusting gap between platen and print head as claimed in claim 1, wherein the adjusting elements make linkwork actions or make actions in separated sections.

15. The device for adjusting gap between platen and print head as claimed in claim 1, further comprising at least a pair of magnets, wherein one of the magnets is disposed at a surface of the platen facing the base, and one of the magnets is disposed at a surface of the base facing the platen.

16. The device for adjusting gap between platen and print head as claimed in claim 15, wherein the magnets with corresponding positions are attractive to each other.

17. The device for adjusting gap between platen and print head as claimed in claim 15, wherein the magnets with corresponding positions are repulsive from each other.

18. An inkjet printer, comprising:

a host, having a casing; and a device for adjusting gap between platen and print head, disposed in the casing and comprising:

a base, disposed at the casing;

a printing unit, located on the base and comprising a print head;

a platen, located between the printing unit and the base, wherein the platen has a platen-portion and a pair of adjusting-portions, the pair of adjusting-portions are disposed at opposite sides of the platen-portion, and each of the adjusting-portions has a step-guiding-surface; and a pair of adjusting elements, disposed beside the platen and correspondingly contacting the step-guiding-surfaces of the pair of adjusting-portions, wherein distance between the platen and the print head is varied with positions of the adjusting elements relative to the step-guiding-surfaces, wherein each of the adjusting elements has a leaning-portion that correspondingly leans against the step-guiding-surface of one of the adjusting-portions, where one of the adjusting elements further has a push-button that is connected to the leaning-portion and located at an end of the leaning-portion far away from the platen-portion.

19. The inkjet printer as claimed in claim 18, wherein the printing unit comprises:

a shaft rod, located on the platen; and the print head, pivoted on the shaft rod and adapted to move along the axis direction of the shaft rod.

20. The inkjet printer as claimed in claim 18, wherein the device for adjusting gap between platen and print head further comprises: at least one elastic element connected between the platen and the base.

21. The inkjet printer as claimed in claim 20, wherein the elastic elements is a tension spring.

22. The inkjet printer as claimed in claim 21, wherein the step-guiding-surfaces face the base.

23. The inkjet printer as claimed in claim 22, wherein steps-segment directions of the step-guiding-surfaces located at opposite sides of the platen are opposite to each other.

24. The inkjet printer as claimed in claim 22, wherein steps-segment directions of the step-guiding-surfaces located at opposite sides of the platen are the same.

25. The inkjet printer as claimed in claim 20, wherein the elastic elements are compression springs.

26. The inkjet printer as claimed in claim 25, wherein the step-guiding-surfaces face the printing unit.

27. The inkjet printer as claimed in claim 26, wherein steps-segment directions of the step-guiding-surfaces located at opposite sides of the platen are opposite to each other.

28. The inkjet printer as claimed in claim 26, wherein steps-segment directions of the step-guiding-surfaces located at opposite sides of the platen are the same.

29. The inkjet printer as claimed in claim 18, wherein there is further a body between the pair of adjusting elements, and the body is connected between the pair of leaning-portion and located beside the platen.

30. The inkjet printer as claimed in claim 18, wherein the push-button, the leaning-portions and the body are integrally formed.

31. The inkjet printer as claimed in claim 18, wherein the adjusting elements make linkwork actions or make actions in separated sections.

32. The inkjet printer as claimed in claim 18, wherein the device for adjusting gap between platen and print head further comprising at least a pair of magnets, wherein one of the magnets is disposed at a surface of the platen facing the base, and one of the magnets is disposed at a surface of the base face the platen.

33. The inkjet printer as claimed in claim 32, wherein the magnets with corresponding positions are attractive to each other.

34. The inkjet printer as claimed in claim 32, wherein the magnets with corresponding positions are repulsive from each other.

35. A device for adjusting gap between platen and print head, comprising:

a base;

a printing unit, located on the base and comprising a print head;

a platen, located between the printing unit and the base, wherein the platen has a platen-portion and a pair of adjusting-portions, the pair of adjusting-portions are disposed at opposite sides of the platen-portion, and each of the adjusting-portions has a step-guiding-surface, wherein steps-segment directions of the step-guiding-surfaces located at opposite sides of the platen are opposite to each other; and a pair of adjusting elements, disposed beside the platen and correspondingly contacting the step-guiding-surfaces of the pair of adjusting-portions, wherein distance between the platen and the print head is varied with positions of the adjusting elements relative to the step-guiding-surfaces.

* * * * *